US008459478B2

(12) United States Patent
Alther et al.

(10) Patent No.: US 8,459,478 B2
(45) Date of Patent: Jun. 11, 2013

(54) SELF-OPENING CLOSURE WITH AIR INLET CHANNEL FOR COMPOSITE PACKAGING OR FOR CONTAINER NECKS TO BE SEALED WITH FOIL MATERIAL

(75) Inventors: Roger Alther, Flurlingen (CH); Rolf Weiss, Fehraltorf (CH); Egon Lang, Schaffhausen (CH); Thomas Hocker, Winterthur (CH)

(73) Assignee: SIG Technology Ltd., Neuhausen am Rheinfall (CH)

( * ) Notice: Subject to any disclaimer, the term of this patent is extended or adjusted under 35 U.S.C. 154(b) by 359 days.

(21) Appl. No.: 12/672,678

(22) PCT Filed: Aug. 8, 2008

(86) PCT No.: PCT/CH2008/000339

§ 371 (c)(1),
(2), (4) Date: Mar. 11, 2010

(87) PCT Pub. No.: WO2009/023976

PCT Pub. Date: Feb. 26, 2009

(65) Prior Publication Data

US 2010/0237073 A1 Sep. 23, 2010

(30) Foreign Application Priority Data

Aug. 22, 2007 (CH) ..... 1318/07

(51) Int. Cl.
*B65D 39/00* (2006.01)

(52) U.S. Cl.
USPC ..... 215/297; 215/220; 220/258.4; 220/259.3; 220/267; 220/277; 220/366.1; 229/125.04; 229/125.15; 222/80; 222/83; 222/91

(58) Field of Classification Search
USPC ..... 215/297; 220/258.4, 259.3, 267, 220/366.1; 222/83, 91; 229/125.04
See application file for complete search history.

(56) References Cited

U.S. PATENT DOCUMENTS 5,141,133 A * 8/1992 Ninomiya et al. ..... 222/83

FOREIGN PATENT DOCUMENTS

| | | | |
|---|---|---|---|
| DE | 3039299 | A1 | 5/1982 |
| EP | 1262412 | A | 12/2002 |
| WO | WO03/101843 | A | 12/2003 |
| WO | WO04/000667 | A | 12/2003 |
| WO | WO2006/050624 | A | 5/2006 |

* cited by examiner

*Primary Examiner* — Anthony Stashick
*Assistant Examiner* — Elizabeth Volz
(74) *Attorney, Agent, or Firm* — CUSPA Technology Law Associates; Yi Li

(57) ABSTRACT

The self-opening closure includes a pouring spout (10), which can be assembled leak-proof on a combipack or a container spout sealed with foil material, twist cap (9) and a self-opening sleeve (1) arranged inside the pouring spout, which can be made to rotate by the twist cap. The self-opening sleeve forms on its upper edge an indentation (4), which becomes smaller towards the bottom edge (6) and tapers off into the same. There are guiding means present on the outer side of the self-opening sleeve and on the inner side of the pouring spout so that the self-opening sleeve is guided downwards by rotation on the pouring spout. The indentation (4) lies partially inside the pouring spout and partially below the same after unscrewing of the cover cap and forms an air inlet channel, which results in a steady outpour of the liquid content of a combipack.

18 Claims, 4 Drawing Sheets

Figure 1:
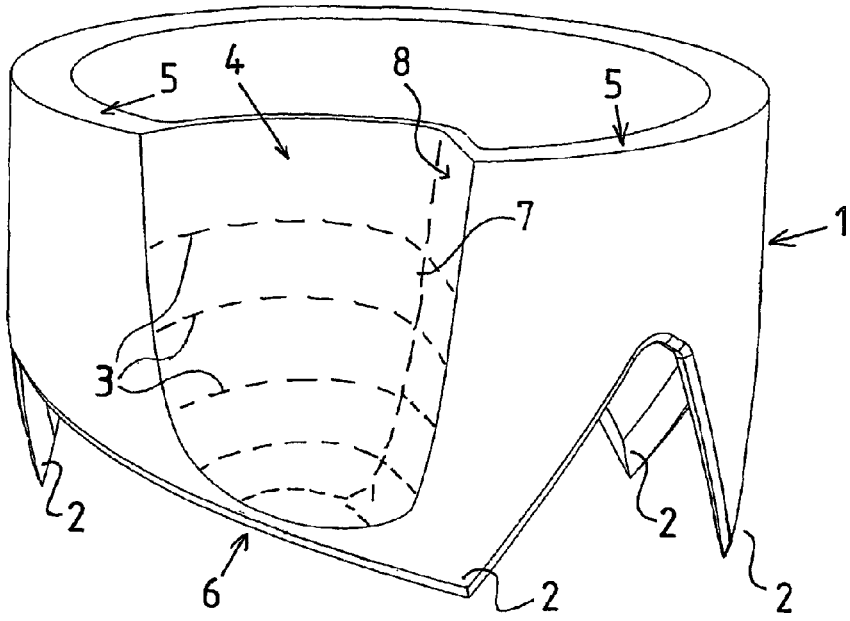

SELF-OPENING CLOSURE WITH AIR INLET CHANNEL FOR COMPOSITE PACKAGING OR FOR CONTAINER NECKS TO BE SEALED WITH FOIL MATERIAL

This invention relates to a self-opening closure with air inlet channel for combipacks as well as for container nozzles to be sealed with foil material of all types. This is intended especially for liquid packs in the form of such combipacks out of foil-laminated paper, in which, for instance, milk, fruit juices, all kinds of non-alcoholic drinks or even general liquids of non-food range are packed. Foil-laminated paper is a laminated material especially with plastic, perhaps with polyethylene and/or aluminium-coated paper or cardboard web. The volumes of such packs usually range from 20 cl upto 2 liters and more. Alternatively, the self-opening closure can also be assembled on containers, which are sealed by a foil material, for example, on all kinds of containers out of glass or plastic or on similar containers, which are tilted over a more or less defined axis for pouring out the contents. Such types of closures out of plastic are well known in various embodiments, but however, without specifically defined air inlet channel. They form, if they are specified for a combipack, essentially a pouring spout with shoulder projecting radially out from its bottom edge, which forms a closing flange at this pouring spout. The spout is equipped with an external thread, on which a threaded cap can be screwed as closure. Such a self-opening closure is flanged on the combipack, in which it is welded or glued leak-proof on the combipack with the bottom side of its projecting edge, that is with the bottom side of its flange. The free passage at the lower end of the spout is thereafter sealed by the lamination or the sealing film of the combipack.

The foil-reinforced paper passing below the welded spout or the foil membrane running within the spout must be cut, torn or pressed out for the opening, so that the passage is made free and the liquid can be poured out from the container through the spout. For this purpose, a sleeve is arranged within the spout, which is driven by the unscrewing of the threaded cap. This moves downwards steadily on the unscrewing of the threaded cap, that is when this is moved upwards against the liquid pack, through a thread on the inner side of the spout and the outer side of the sleeve. The bottom edge of the sleeve is provided with one or more cutting teeth. The sleeve cuts out a disc from the foil-reinforced paper or the foil membrane running through below it as a result of its rotation and presses this subsequently downward. There are self-opening sleeves, which are axially pushed straight downwards on the strength of driving means. Others perform subsequently a straight rotation. Likewise, there exist such ones, in which both these movements are superimposed to a helical shape or to a spiral with pitch larger at first and then gradually becoming smaller.

Such conventional self-opening closures are still improvable, especially those concerned with the pouring out property. Since these self-opening closures do not form any defined air inlet for the pouring out, the pouring out occurs in gushes for large tipping positions, which is in practice uncomfortable and leads to the spillage of the content.

The task of the present invention is to create a self-opening closure for combipacks or for container nozzles to be sealed with foil material or already sealed with foil material, which allows a clean and controlled and steady outpour of the liquid content.

This problem is solved by a self-opening closure for combipacks as well as for container nozzles to be sealed with foil material consisting of a pouring spout, which can be assembled leak-proof on a combipack or on a container spout to be sealed with foil material, an appropriate twist cap as well as a self-opening sleeve arranged within the pouring spout, which can be made to rotate by the twist cap, and which is characterised in that the self-opening sleeve forms an indentation for the formation of an air inlet channel on the upper edge, which is smaller towards the bottom and tapers off into the bottom circular edge in the top view.

A favourable embodiment of this self-opening closure is represented in the figures in different views. Subsequently, the self-opening closure is described individually and its function is explained and clarified based on these figures.

Figure 2:
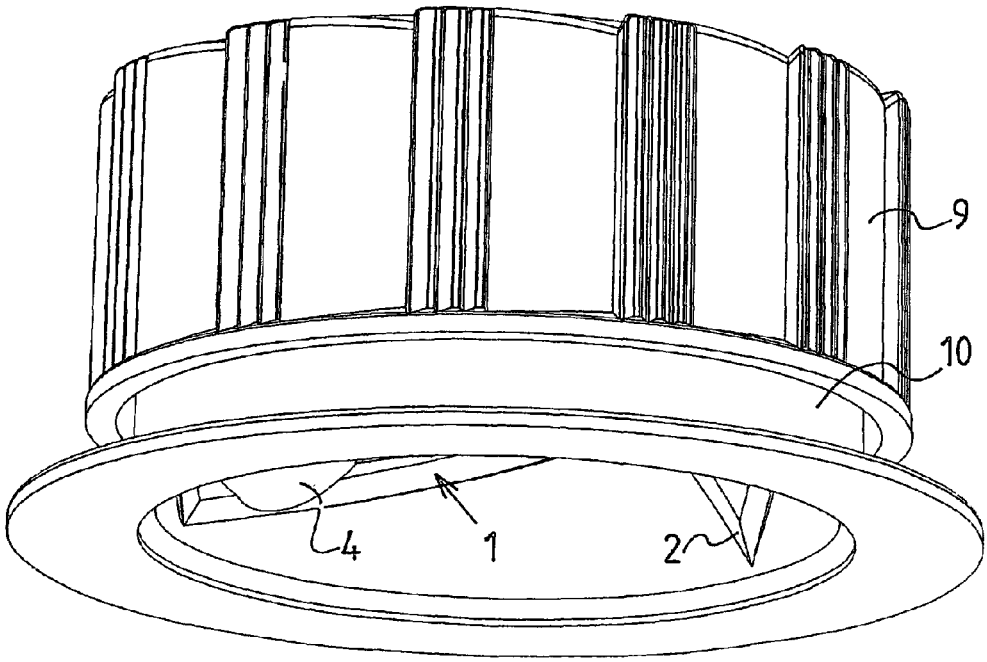
Figure 3:
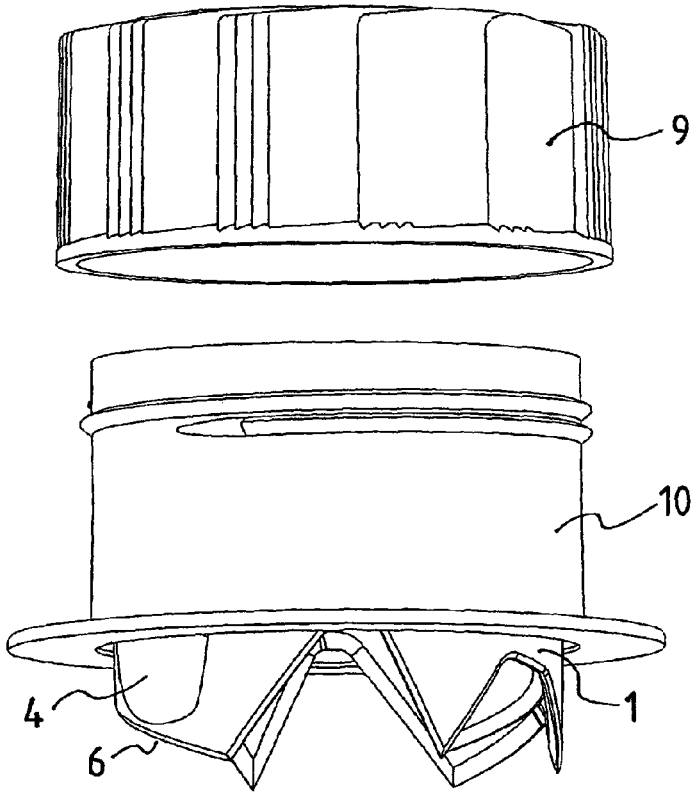
Figure 4:
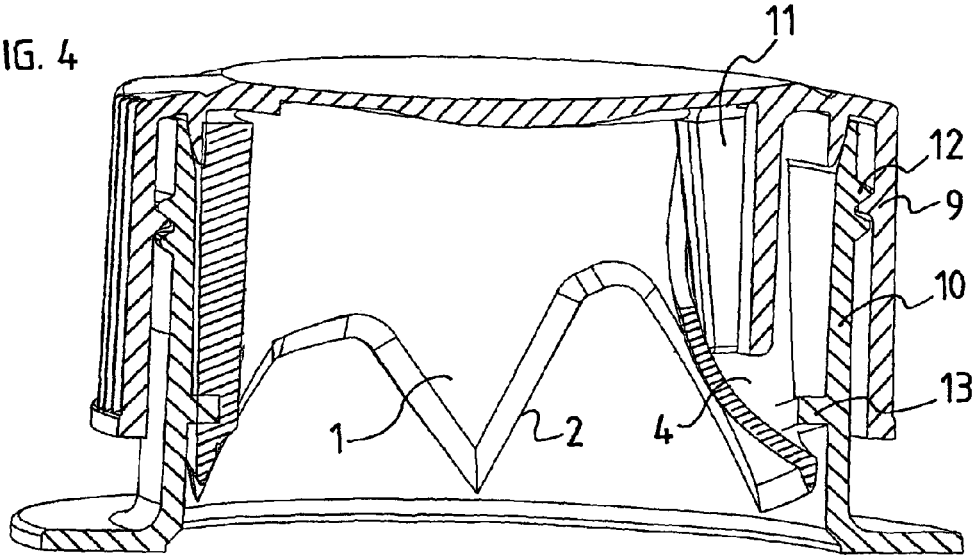
Figure 5:
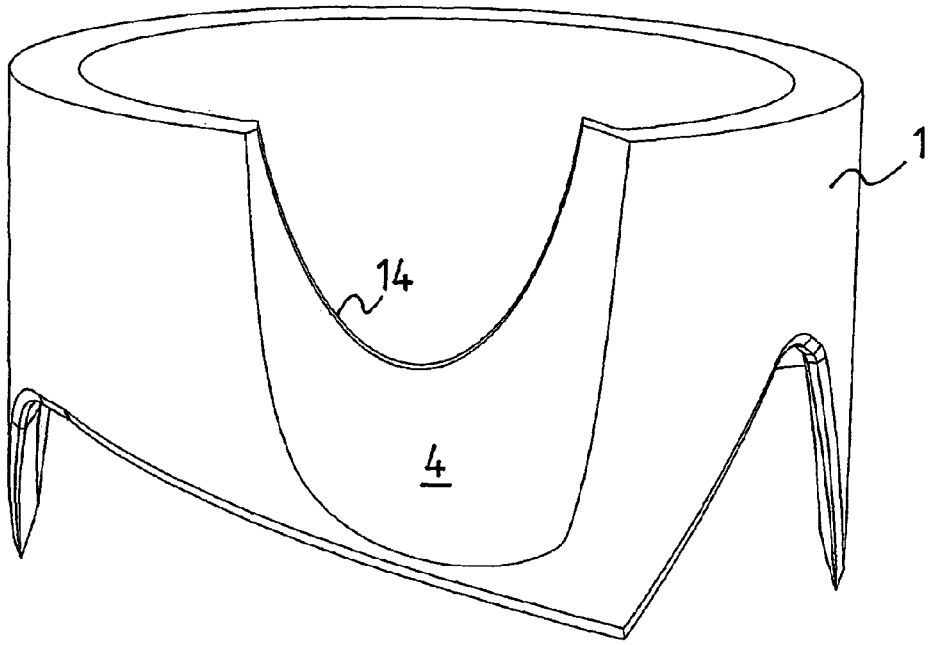
Figure 6:
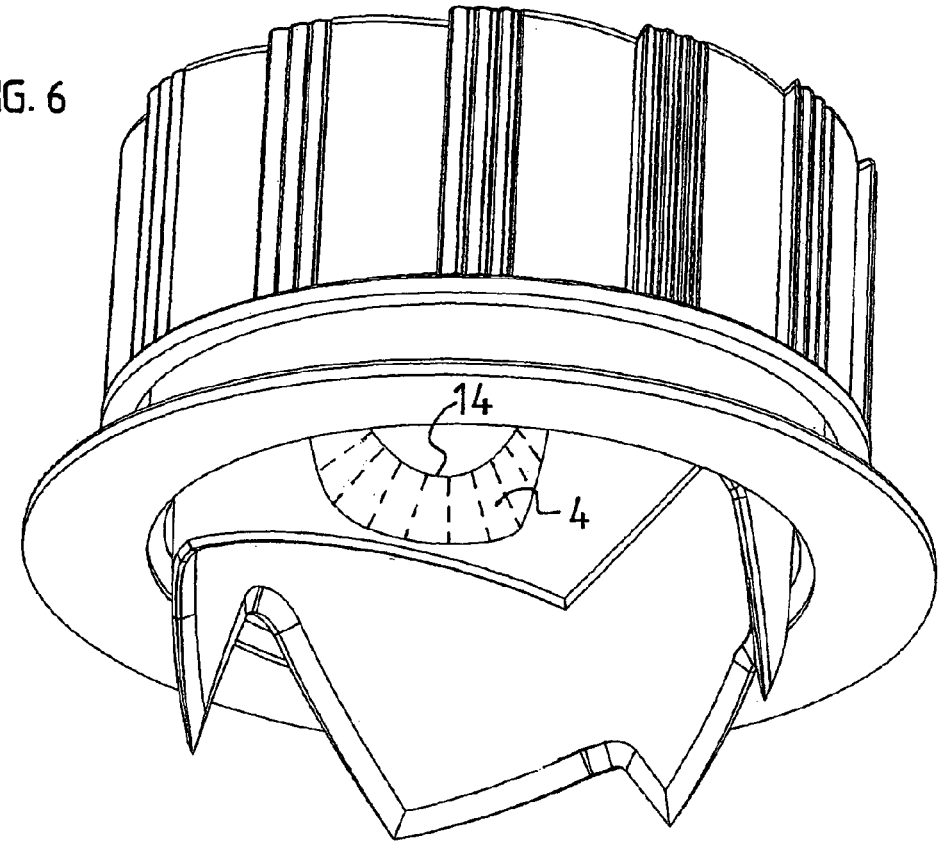
Figure 7:
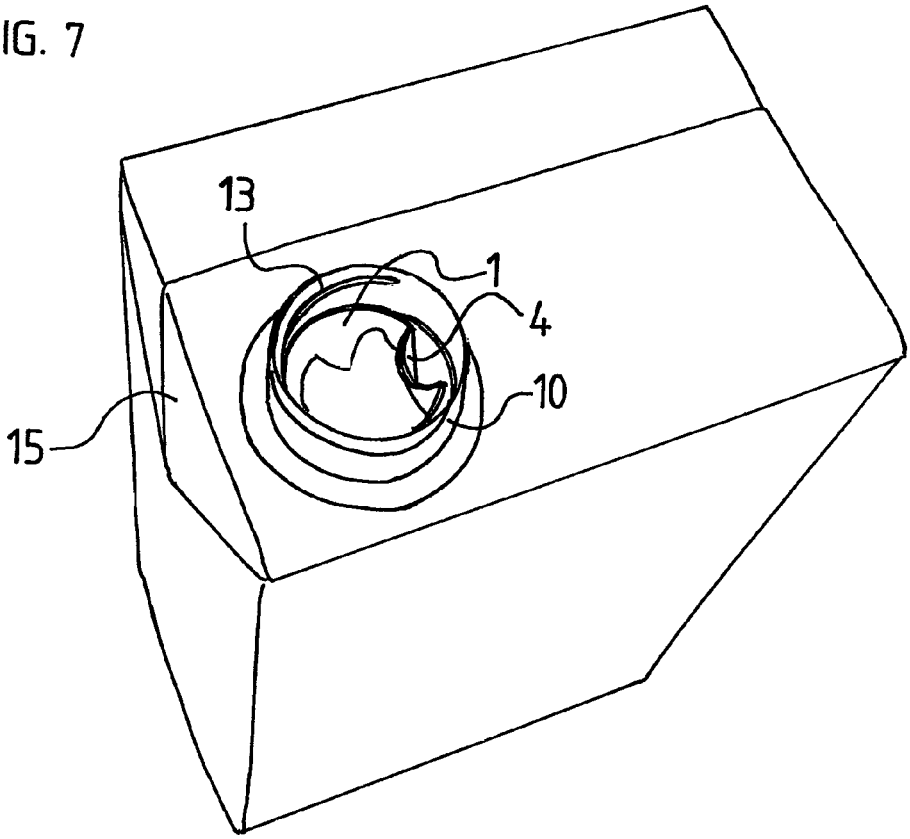

The figures show:

FIG. 1: The self-opening sleeve of the closure represented in perspective view with the position turned towards the viewer with the indentation;

FIG. 2: The self-opening closure seen from the slanted bottom with the self-opening sleeve lying inside in its initial condition;

FIG. 3: The complete self-opening closure with its three parts, namely the cover cap, the pouring spout and the self-opening sleeve after the unscrewing and removing of the cover cap;

FIG. 4: The self-opening closure shown in a diametrical section;

FIG. 5: A self-opening sleeve with a variation, namely a cut out at the indentation;

FIG. 6: The complete self-opening closure with its three parts seen at an slanted angle from below, namely the cover cap, the pouring spout and the self-opening sleeve after the unscrewing and replacement of the cover cap;

FIG. 7: The opened self-opening closure assembled on a combipack.

In FIG. 1, the self-opening sleeve 1 of this self-opening closure is shown as a separate part. The bottom edge 6 forms several cutting teeth 2, which taper off each to a sharp edge. These cutting teeth 2 are used for the piercing of a foil running below the self-opening closure and for their cutting off afterwards so that an approximately round disc is cut out. This self-opening sleeve 1 forms at its top edge 5 an indentation 4 as a characteristic feature, which becomes smaller towards the bottom edge 6 of the self-opening sleeve and finally tapers off into the circular bottom edge seen from above. This indentation 4 is curved, which is made clear here with the broken projection lines 3, and forms the shape of a shovel or a spoon. The radius of its concave curvature becomes continuously smaller towards the bottom edge 6 of the self-opening sleeve 1 and finally runs into the bottom edge 6. But, the rounding or curvature of this indentation 4 need not be the same all over but can form approximately a corner on one side of the rounding as in the example shown, which is made clear with a broken projection line 7. Consequently, a shoulder 8 is formed in the upper area of the indentation 4 on the outer side of the sleeve 1, which serves as stop face for an actuating cam at the inner side of the cover cap. In another embodiment, a shoulder can be formed on the side lying opposite in the circumferential direction of the self-opening sleeve so that the actuating cam then engages the indentation 4 from inside the self-opening sleeve 1 and thus hits from outside at the convex indentation 4 there.

The FIG. 2 shows the self-opening closure preassembled on cover cap 9, pouring spout 10 and self-opening sleeve 1. This fits fully inside the pouring spout 10. Since one sees the cap at a slanted angle from below in the FIG. 2, one can easily recognise the cutting teeth 2 with their sharp edges and the indentation 4, which can be seen here from the inner side of the self-opening sleeve 1.

The FIG. 3 shows all parts of this self-opening closure after its opening. One can see the cover cap 9 at the top; the pouring spout 10 below that and the self-opening sleeve 1 projecting from the same below. The cover cap 9 was unscrewed from the pouring spout 10 with an anticlockwise rotation and removed. The self-opening sleeve 1 was carried along in the same rotating direction while unscrewing. Therefore, it also executes an anticlockwise rotation and was rotated downwards by guiding means until it reaches the end position shown here. The cutting teeth projected from the pouring spout 10 in this end position and the indentation 4 has passed the bottom edge of the pouring spout 10 approximately to the middle. The indentation 4 forms an air inlet channel in this position for the pouring out. The self-opening closure is assembled on a pack in such a way that the indentation 4 comes to lie in the upper closure of the closure if the pack is tilted for the pouring out with opened closure. The rotation of the cover cap 9 necessary for the rotating downward of the self-opening sleeve 1 extends by about 120°. Thereafter, the actuating cam at the bottom side of the cover cap 9, not visible here, glides out of the indentation 4 and rotates idly further afterwards. The cap is therefore positioned in such a rotary position on the pack that the indentation 4 stands at first at about 10.00 o'clock, seen from above, on the closure if the pouring out must take place over the 12.00 o'clock position of the plug neck. If the twist cap 9 is then turned anticlockwise, the self-opening sleeve 1 is turned in the same sense by 120° to the 06.00 o'clock position and then stands in the upper closure of the pouring spout 10 in the tilted position of the combipack.

The FIG. 4 shows the self-opening closure with air inlet channel in a diametrical section, in which the cut surfaces are shown hatched. One can recognise in this representation the actuating cam 11, which is formed axially on the inside of the cover cap 9. This actuating cam 11 engages within the concave indentation 4 in the self-opening sleeve 1 in the embodiment of the cap shown, thus butts against the self-opening sleeve 1 outside. The cover cap 9 is screwed on over an external thread 12 on the pouring spout 10. The self-opening sleeve 1 is on the other hand held in the inner wall of this pouring spout 10 and carried. A projection 13 formed on this inner wall engages in the corresponding guiding means on the outside of the self-opening sleeve 1. If the cover cap 9 is rotated counter clockwise, as seen from above, the actuating cam 11 strikes at the shoulder 8 of the indentation 4 and consequently the self-opening sleeve 1 rotates along with in the same direction and the self-opening sleeve 1 slides downwards, that is, it performs, for example, a helical movement towards the bottom. The indentation 4 lies in the end position in such way that a part still lies inside the pouring spout 10 while the other projects below from the pouring spout 10 as is already shown in FIG. 3.

The indentation 4 forms an air inlet channel in its end position for the pouring out. Therefore, if the combipack is tilted to the pouring-out position, air flows by design into the combipack immediately from outside through this air inlet channel. The indentation 4 is formed in such a way that the air inlet channel tapers towards the container interior and is deflected to the pouring spout with a radial component in the container interior. The airflow is accelerated there by the tapering and makes it possible that the liquid does not essentially disrupt this airflow taking place during further tilting of the combipack so that it still continues. The indentation 4 forms a flow resistance with its side turned towards the inside of the pouring spout 1 for the liquid stream flowing out. That results in positive flow dynamics, because the flow is formed in such a way that it is in effect not possible to disrupt the inflowing airflow and continuous flowing out of the liquid is achieved.

The FIG. 5 shows an alternative embodiment of the indentation 4 in the self-opening sleeve 1. This indentation 4 is namely cut out parabolic shaped at its upper edge 14. It has proved that such a parabolic-shaped upper edge 14 affects favourably the flow condition during the pouring out. In FIG. 6, one sees this self-opening sleeve assembled in the cap, namely in its end position, after the opening of the self-opening closure, here with the cover cap screwed on again afterwards. Here, a lower part of the indentation 4 projects out below from the pouring spout 10 while an upper part still projects inside in the pouring spout 10. However, one can recognise here only a part of the upper parabolic-shaped edge 14 of the indentation 4. The liquid flows past this parabolic-shaped edge 14 during the pouring out and is formed into an approximately even stream surface by it so that the liquid stream thus forms to some extent a secant on this upper side in the pouring spout 10 during the pouring out. This allows space for the entering air and it flows consequently through the indentation 4 into the interior of the combipack and enables a steady discharge stream. It is clear that similar results can be achieved also with other forms of indentations and other forms of edges.

The opened self-opening closure on a combipack 15 can be seen in FIG. 7. As one can recognise, here the indentation 4 in the self-opening sleeve 1 lies exactly in the upper closure with reference to the tilted position for the pouring out. In this view, one can recognise a projection 13 running helical-shaped on the inner side of the pouring spout 10 in the example shown. However, this guide for the forcing of the downward movement of the self-opening sleeve 1 during the unscrewing of the twist cap can also be designed differently. In any case, the self-opening sleeve 1 moves downwards until it reaches the end position shown here. The indentation 4 forms an air channel on its outer side for the inflowing air directed towards the inner side of the pouring spout. The entering air stream as well as the exiting liquid stream are formed through this indentation 4 in such a way that the liquid stream remains steady and flows out without creating gushes.

The invention claimed is:

1. A self-opening closure for a combipack or a container spout sealed with a foil material, said self-opening closure comprising:

a pouring spout (10) adapted to be assembled leak-proof on a combipack (15) or a container spout sealed with a foil material;

a twist cap (9) engaged with the pouring spout (10); and a self-opening sleeve (1) arranged within the pouring spout (10) and adapted to be moved downward by the twist cap (9) inside the pouring spout; said self-opening sleeve (1) having a portion bent toward an interior thereof, forming an indentation (4) on an outer side of the self-opening sleeve (1); said indentation (4) extending from an upper edge (5) of the self-opening sleeve (1) downward and tapering toward a bottom edge (6) of the self-opening sleeve, and said indentation (4) forming an air channel for the combipack or a container.

2. The self-opening closure according to claim 1, wherein the indentation (4) tapers off into the bottom edge (6) of the self-opening sleeve in a top view.

3. The self-opening closure according to claim 1, wherein the indentation (4) on the self-opening sleeve (1) has a square cross-sectional shape.

4. The self-opening closure according to claim 1, wherein the bottom edge (6) of the self-opening sleeve (1) forms multiple cutting teeth (2) for cutting the foil material running below the self-opening closure.

5. The self-opening closure according to claim 1, wherein the indentation (4) lies partially inside the pouring spout (10) and partially below the pouring spout after the twist cap is unscrewed.

6. The self-opening closure according to claim 1, wherein the indentation (4) on the self-opening sleeve (1) has a curved shape, with a radius of a concave curvature becoming smaller toward the bottom edge of the self-opening sleeve.

7. The self-opening closure according to claim 6, wherein the indentation (4) on the self-opening sleeve (1) is shovel- or spoon-shaped, and tapers off toward the bottom edge (6) of the self-opening sleeve.

8. The self-opening closure according to claim 1, wherein the upper edge (5) of the self-opening sleeve (1) has a cut out at the indentation.

9. The self-opening closure according to claim 8, wherein an upper edge (14) of the indentation has a parabolic shape.

10. The self-opening closure according to claim 1, further comprising guiding means on an outer side of the self-opening sleeve and on an inner side of the pouring spout (10), so that the self-opening sleeve (1) is guided downwards by rotation inside the pouring spout.

11. The self-opening closure according to claim 10, wherein the pouring spout (10) has a helical-shaped projection (13) on an inner wall thereof.

12. The self-opening closure according to claim 1, wherein the self-opening sleeve (1) is adapted to be rotated downward by the twist cap.

13. The self-opening closure according to claim 12, wherein the self-opening sleeve (1) can be rotated by a definite angle in the pouring spout (10), so that the self-opening closure can be assembled in a manner that the self-opening closure sits on the combipack or the container with the indentation (4) on the outer side of the self-opening sleeve (1) in an upper side with reference to the pouring spout in a pouring out position after the twist cap is unscrewed off.

14. The self-opening closure according to claim 13, wherein at the pouring out position, the air channel formed by the indentation (4) on the outer side of the self-opening sleeve tapers toward an interior of the container, resulting in an airflow acceleration.

15. The self-opening closure according to claim 1, wherein the twist cap (9) comprises an actuating cam (11) projecting downwards from the twist cap, adapted to engage with the self-opening sleeve (1).

16. The self-opening closure according to claim 15, wherein the indentation (4) has a radial section on one side thereof forming a shoulder (8) for engaging with the actuating cam (11).

17. The self-opening closure according to claim 15, wherein the actuating cam (11) engages with the indentation (4) from outside of the self-opening sleeve (1).

18. The self-opening closure according to claim 15, wherein the actuating cam (11) engages with the indentation (4) from inside of the self-opening sleeve (1).

* * * * *